United States Patent [19]

Kincaid

[11] 4,196,825

[45] Apr. 8, 1980

[54] LAMINATED COLLAPSIBLE TUBE

[75] Inventor: Thomas R. Kincaid, Stamford, Conn.

[73] Assignee: Colgate-Palmolive Company, New York, N.Y.

[21] Appl. No.: 768,792

[22] Filed: Feb. 14, 1977

Related U.S. Application Data

[63] Continuation of Ser. No. 611,149, Sep. 8, 1975, abandoned.

[51] Int. Cl.[2] ..... B65D 35/14

[52] U.S. Cl. ..... 222/107; 156/218

[58] Field of Search ..... 222/92, 107, 207, 215; 93/36.8; 229/48 T, 5.5, 5.6; 156/217, 218, 226, 227

[56] References Cited

U.S. PATENT DOCUMENTS

| | | | |
|---|---|---|---|
| 1,948,570 | 2/1934 | Ferenci | 53/39 |
| 2,374,858 | 5/1945 | Friedrichs | 222/107 |
| 2,398,505 | 4/1946 | Pepin | 222/107 |
| 2,440,339 | 4/1948 | Langer | 222/107 |
| 3,260,411 | 7/1966 | Dobson | 222/107 |

FOREIGN PATENT DOCUMENTS

| | | | |
|---|---|---|---|
| 554415 | 7/1943 | United Kingdom | 222/92 |

*Primary Examiner*—H. Grant Skaggs

*Attorney, Agent, or Firm*—Herbert S. Sylvester; Murray M. Grill; Norman Blumenkopf

[57] ABSTRACT

A flexible dispensing tube is disclosed having a laminated plastic-metal-plastic wall, the metal layer having at least one irregular surface for improved deadfold at the folded bottom end.

1 Claim, 7 Drawing Figures

FIG. 1
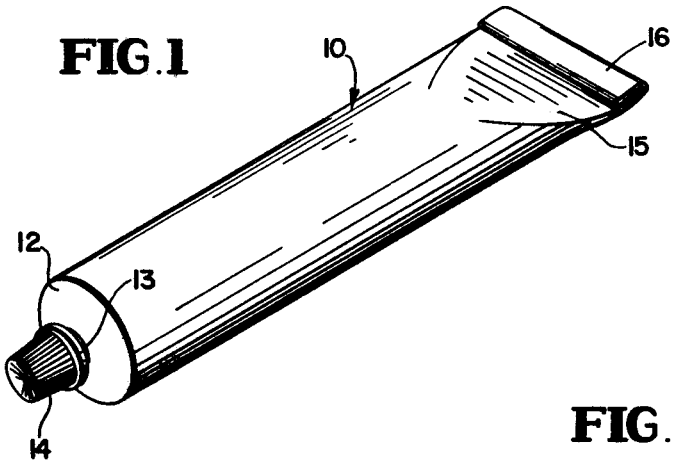
FIG. 2
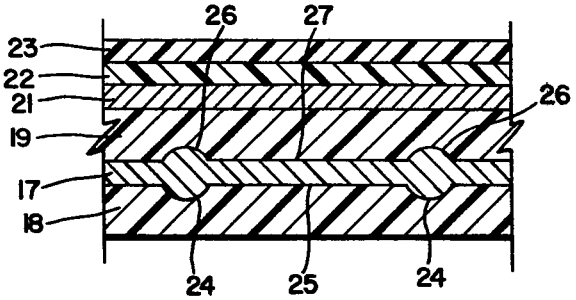
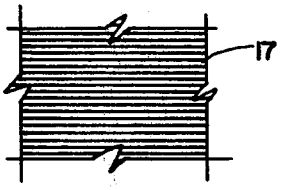
FIG. 3
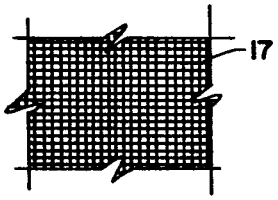
FIG. 4
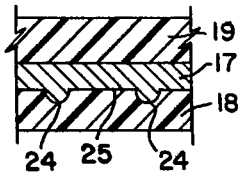
FIG. 6
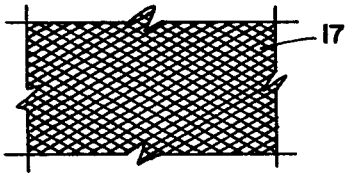
FIG. 5
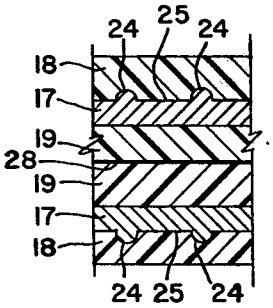
FIG. 7

LAMINATED COLLAPSIBLE TUBE

This is a continuation of application Ser. No. 611,149 filed Sept. 8, 1975, now abandoned.

This invention relates to flexible walled dispensing tubes, such as toothpaste tubes, and the method of making the same and is particularly concerned with a tube structure that provides for better sealing of the tube after it is filled with its contents.

In common practice, these tubes when empty are first tightly fitted with the screw cap, then filled with the contents usually paste or cream compositions through the open lower end, and then the open end of the tube is flattened, folded over and permanently closed at the lower end.

The invention herein is peculiarly applicable to tubes wherein the flexible side walls are laminated metal foil and synthetic plastic layers, usually with the metal layer intermediate two layers of plastic. Such laminated wall tubes have in general replaced prior art metal tubes, because plastics are less expensive and thinner metal layers may be thereby used. In addition, various plastics are more inert relative to the tube contents than aluminum and present a more polished external appearance. When these tubes have been filled with the required compositions they are closed by either a folding and crimping action accompanied by heating whereby contacting surfaces of the plastic, for example a thermoplastic polyethylene or polypropylene, are tightly sealed at the fold, or by heat sealing the inner plastic surfaces without a fold in which case care must be taken to avoid contamination of the inner sealing surfaces by the product which might prevent a good heat seal.

Machines for closing the lower ends of these tubes are known as disclosed for example in the patents to Hallead et al U.S. Pat. Nos. 2,389,506; Westin 2,007,653 and Garney et al 3,424,805; the latter two having heated folding jaws for effecting the sealing action with laminated metal-plastic walled tubes.

Problems have arisen however in that the aluminum layer in the laminate, which may be a sheet only about 0.7 mils. thick to avoid excessive overall thickness of the wall, may not possess sufficient deadfold to retain the folded configuration until an effective seal is formed. The high production speeds required in a commercial operation require a very short residence time for the tube end in the sealing jaws. The short residence time results in premature release of the tube end from the sealing jaws which usually effects some separation of the fused plastic surfaces and often destroys the seal. This objectionable condition is enhanced when, as is often the case, some of the composition with which the tube is filled smears areas of the plastic surfaces in the fold region during the filling operation, thereby preventing full surface bonding of the plastic surfaces in contact.

Attempts have been made to solve the problem by internal heat sealing after tube is filled, but these are expensive and not satisfactory.

The invention herein consists in the discovery that by imparting or providing a surface irregularity to or texturizing at least one surface of the aluminum layer in the laminate the deadfold properties and characteristics of the laminate are unexpectedly increased without resorting to a thicker metal layer as the state of the art would suggest. When a tube wherein the laminated plastic-metal-plastic wall with one or both metal surfaces irregular has its ends closed as in a heated jaw machine such as in the Westin or Garney et al patents at normal commercially acceptable residence times, the folded end faithfully retains its imparted fold condition so that the fused regions remain together and harden and retain the seal. The provision of and the method of making a tube of this construction are the major advantages of the invention.

Whether or not the folded joint is heat sealed the texturized metal layer provides a markedly improved mechanically locked deadfold joint without increasing the metal thickness and this is another important advantage.

The invention thus permits the use of a minimum thickness layer of metal while attaining the deadfold end characteristics observed in all-metal tubes wherein the metal is thicker, thereby conserving metal and retaining optimum tube wall thickness.

Further novel features and other objects of this invention will become apparent from the following detailed description, discussion and the appended claims taken in conjunction with the accompanying drawings.

BRIEF DESCRIPTION OF DRAWINGS

FIG. 1 shows a collapsible dispensing tube of the type to which the invention is particularly adaptable;

FIG. 2 is an enlarged fragmentary cross section of a wall of the tube of FIG. 1;

FIGS. 3–5 are plan views showing different irregular surface configurations.

FIG. 6 is a fragmentary cross section of another embodiment of a wall of the tube of FIG. 1; and FIG. 7 is a fragmentary cross section of a folded and heat-sealed closure joint of a tube with walls as shown in FIG. 6.

In the several figures, like numerals refer to like parts.

PREFERRED EMBODIMENTS

FIG. 1 illustrates a flexible walled dispensing tube of conventional form, comprising a tubular body 10 having at the discharge end a shoulder 12 from which projects a threaded hollow nozzle 13 bearing a removable closure cap 14. The lower portion of the tube indicated at 15 is permanently closed after the contents are inserted and terminates in the folded and crimped end joint indicated at 16. Tube 10 is of standard construction, except for the body wall as will appear, and is made on standard machines in conventional operations.

Referring now to FIG. 2, a cross section of the tube wall is illustrated. A layer of metal 17 has layers 18 and 19 of a thermoplastic such as polyethylene full surface bonded to it on opposite sides, the layer 18 being at the inner surface of the tube body in contact with the composition to be dispensed.

A layer of paper 21, printed with names, directions, etc. overlies layer 19, and successive layers 22 and 23 of white polyethylene and clear polyethylene overlies the paper layer.

In the invention one or both surfaces of the metal layer are irregular. Such irregularity may comprise any regular or random departure from a smooth continuous surface, such as the projections 24 embossed on the inner surface 25 of the metal layer in FIG. 2. Projections 26 may be provided on the outer surface 27 of the metal layer in FIG. 2, although it may be desirable to omit projections 26 to eliminate the possibility of objectionable bulges or the like on the outer surface of the tube.

A preferred embodiment of a wall omitting outer surface projections 26 and overlying layers 21, 22 and 23 is illustrated in cross-section in FIG. 6. FIG. 7 illustrates in cross section a folded closure joint of a tube with walls as shown in FIG. 6, heat-sealed at 28.

In practice it may be necessary to impart an irregular or disrupted surface only to the metal layer portion that is disposed in the bottom region 15 of the tube where the tube is folded, although where the tube body may be formed from a rolled sheet having an end seam the entire layer or at least the side edge areas of the sheet may also have at least one irregular surface to ensure good deadfold and seal at the longitudinal seam.

An irregular surface as the term is used herein and in the claims is one that is not smooth and continuous but is markedly discontinuous. It may be imparted by knurling, punching, grooving, pressing, abrading or like mechanical operations, or by etching or splattered molten particles, on the relatively ductile aluminum layer prior to its lamination with the polyethylene. The irregularity may be provided after the laminate is formed by passing at least the portion that is to be the closed lower end between engraved or embossed pressure rollers. Both rollers may have irregular surfaces, for creating irregularities on both sides of the metal layer, or one roller may be smooth so that the irregularity is formed on only one side of the metal layer. FIGS. 3, 4 and 5 show linear, waffle and knurled patterns respectively for the irregular surface. Preferably the projections and/or depressions of the irregular surface are closely spaced, and the irregularities may be uniform or randomly distributed over the surface.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A flexible walled dispensing tube having a discharge nozzle at one end and a relatively flat folded permanent closure joint at the other end, said tube having a laminated wall, said laminated wall including an inner thermoplastic layer, an intermediate metal layer and an outer thermoplastic layer, said metal layer being a thin sheet of bendable metal having an irregular surface at least in the lower region of said tube wall where said folded joint is formed, said irregular surface being bonded to said inner thermoplastic layer, the other side of said metal layer being smooth and continuous, said closure joint including a laminate of thermoplastic-metal-thermoplastic-thermoplastic-metal-thermoplastic, said adjacent thermoplastic layers being joined solely by a heat seal, each of said metal layers in said closure joint having at least one irregular surface said irregular surface comprising relatively closely spaced integral projections on the surface.

* * * * *